US009470392B2

(12) United States Patent
Santiago

(10) Patent No.: US 9,470,392 B2
(45) **Date of Patent: *Oct. 18, 2016**

(54) ORNAMENT WITH BACKLIT FILM IMAGE

(71) Applicant: Robert L. Santiago, Hilo, HI (US)

(72) Inventor: Robert L. Santiago, Hilo, HI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/868,269

(22) Filed: Sep. 28, 2015

(65) Prior Publication Data

US 2016/0018076 A1 Jan. 21, 2016

Related U.S. Application Data

(63) Continuation-in-part of application No. 13/248,646, filed on Sep. 29, 2011, now Pat. No. 9,146,010.

(60) Provisional application No. 61/393,227, filed on Oct. 14, 2010, provisional application No. 61/388,897, filed on Oct. 1, 2010.

(51) Int. Cl.

| | |
|---|---|
| ***F21V 13/10*** | (2006.01) |
| ***G09F 13/14*** | (2006.01) |
| ***F21V 3/02*** | (2006.01) |
| ***F21V 1/22*** | (2006.01) |
| ***F21V 7/04*** | (2006.01) |
| ***G09F 13/04*** | (2006.01) |
| ***A47G 33/08*** | (2006.01) |
| *F21W 121/00* | (2006.01) |

(52) U.S. Cl.

CPC ..... *F21V 3/02* (2013.01); *A47G 33/0836* (2013.01); *F21S 4/10* (2016.01); *F21V 1/22* (2013.01); *F21V 7/045* (2013.01); *G09F 13/0413* (2013.01); *F21W 2121/00* (2013.01); *G09F 2013/0481* (2013.01)

(58) Field of Classification Search

CPC ..... G09F 11/02; G09F 11/025; G09F 11/23; G09F 13/04; G09F 13/0404; G09F 13/0409; G09F 13/0413; G09F 7/22; G09F 15/0081; G09F 2013/0481; G09F 2013/0477; G09F 2013/0464; F21V 1/22; F21V 3/02; F21V 3/04; F21V 3/0472; F21V 3/049; F21V 3/023; F21V 17/002; F21V 17/005; F21V 17/16; F21V 19/0035; F21V 19/0045; F21V 15/01; F21V 15/011; F21V 7/04; F21V 7/045; F21V 29/505; F21S 4/00; F21S 4/001; Y10S 362/812; A47G 1/0622; G04B 19/21

See application file for complete search history.

(56) References Cited

U.S. PATENT DOCUMENTS

| | | | |
|---|---|---|---|
| 986,590 | A | 3/1911 | Persons |
| 1,000,231 | A | 8/1911 | Bowles |

(Continued)

*Primary Examiner* — Alan Cariaso

(74) *Attorney, Agent, or Firm* — Lowry Blixseth LLP; Scott M. Lowry

(57) ABSTRACT

An ornament with a backlit film image having a curved substrate with a smooth surface and an at least partially transparent portion viewable therethrough when backlit. The backlit film image includes a flat top surface and a flat bottom surface, wherein one of the flat top surface or the flat bottom surface is positioned flush against the smooth surface of the curved substrate when the backlit film image is removably coupled thereto. A first end cap and a second end cap are configured to receive and retain a portion of the substrate such that the first and second end caps and the substrate support one another into a substantially upright position to define an enclosure. An insert removably engages one of the first or second end caps and includes an aperture having a size and shape for compression-fit engagement with a light source.

19 Claims, 7 Drawing Sheets

(56) References Cited

U.S. PATENT DOCUMENTS

| | | | | |
|---|---|---|---|---|
| 1,180,138 | A | 4/1916 | Giese | |
| 1,592,595 | A | 7/1926 | Arendt | |
| 1,663,386 | A | 3/1928 | Rice | |
| 2,339,385 | A | 1/1944 | Dupler | |
| 3,109,252 | A | 11/1963 | Schellenberg | |
| 3,587,185 | A | 6/1971 | Deal | |
| 3,764,801 | A | 10/1973 | Mainieks | |
| 4,196,535 | A | 4/1980 | Heimo | |
| 4,290,096 | A | 9/1981 | Szpur | |
| 4,953,067 | A | 8/1990 | Moore | |
| 5,184,890 | A | 2/1993 | Chen et al. | |
| 5,513,084 | A | 4/1996 | Simpson | |
| 5,609,411 | A * | 3/1997 | Wang | F21L 11/00 362/234 |
| 5,685,635 | A | 11/1997 | Barthelmess | |
| 5,809,679 | A | 9/1998 | Arjmand | |
| 5,911,501 | A | 6/1999 | Katz | |
| 6,010,236 | A | 1/2000 | Lai | |
| 6,282,825 | B1 * | 9/2001 | Godfrey | G09F 7/12 40/574 |
| 7,946,735 | B2 | 5/2011 | Chou et al. | |
| 9,146,010 | B2 * | 9/2015 | Santiago | F21S 4/001 |
| 2009/0323315 | A1 * | 12/2009 | Tuite | G09F 13/04 362/98 |
| 2011/0233593 | A1 | 9/2011 | Kawagoe et al. | |

* cited by examiner

ORNAMENT WITH BACKLIT FILM IMAGE

BACKGROUND OF THE INVENTION

This invention relates generally to an ornament including backlit film bearing a custom image formed into a generally cylindrical shape and retained in the form of a hollow cylinder by circular upper and lower retainer caps. At least one of these retainer caps, such as the upper cap, has a small opening formed therein to receive a light source, such as a light mounted along an elongated strand of the type used for Christmas decorations.

Backlit film is generally known in the art for use in printing a custom image onto the film, and then backlighting the printed film to illuminate the custom image. Such backlit film is often used in the preparation of posters and the like of generally planar shape. Backlit film has recently become available for use in home printing applications, such as by use of an inkjet printer or the like for printing of a wide variety of home artwork, such as individual photographs of friends and relatives. Exemplary backlit film is commercially available in rolls of different sheet lengths suitable for use with wide format inkjet media from Eastman Kodak Company, Rochester, N.Y., under the brand name Kodak Premium Backlit Film, or from Hewlett-Packard Development Company of Houston, Tex., under the brand name HP Premium Vivid Color Backlit Film.

The prior art discloses several different types of ornaments that use light to illuminate an image or sign, but such devices tend to be overly complex and expensive to manufacture, which can significantly inhibit commercial viability. Moreover, none of these prior art devices incorporate a backlit film image in the manner disclosed herein, and as briefly mentioned above. For example, U.S. Pat. No. 3,587,185 to Deal discloses an omni-directional sign that includes a refracting cylinder having a light source disposed therein. The cylinder includes a series of individual refracting rings, wherein each ring, in turn, consists of a large number of individual refracting elements. These refracting elements are grouped together in identical sequences equally spaced around the periphery of the cylindrical element. These refracting elements or sidewall corrugations of the refracting cylinder are shown generally with respect to the cross-sectional views of FIGS. 1-2 and 17-18. Accordingly, the cylinder wall includes a first set of surfaces radial to the cylinder, and a second set of surfaces which are opaque to prevent light from passing through to the cylinder. An imprinting roller may press-fit these corrugations (e.g., the refracting, radial or opaque surfaces) to the surface of the cylinder by hot pressing it against a second, smooth roller. Then, the opaque surfaces, which stand out from the refracting or radial surfaces, are painted by a second similar set of rollers. Such corrugation results in several different surfaces oriented at angles relative to one another, including a jagged surface characterized by numerous peaks and valleys. Deal discloses a variety of these repeating refracting surface arrangements, some of which involve complex combinations of radial, tangential, and angled surfaces, all of which are jagged, as shown, e.g., in FIGS. 4, 4*a*, 5 and 7. As a result of the un-even alternating surface structure formed as part of the refracting surfaces of the cylinder, Deal requires the opaque surfaces to prevent light scattering. In this respect, a portion of the refracting surfaces are either painted black, as mentioned above, to absorb the light or painted silver to reflect the light. These opaque surfaces inhibit full and even illumination of substantially the entire surface area of the backlit image, especially since the backlit image cannot sit flush with substantially the entire surface area of the cylinder because of the many corrugations which create outwardly extending "peak" sections, which sometimes form only a single point of contact for the backlit image, e.g., as shown in FIGS. 4 and 4*a*, and the corresponding depressed "valley" sections. This corrugated structure has a specific purpose, when combined with a single smooth cylindrical surface, to create prismatic refracting elements that permit variations in the displayed image, depending on the angular viewing position relative to the omni-directional sign. While this may be desired for the image disclosed in Deal, it is particularly undesirable for full and even illumination of a backlit film image not meant to be distorted depending on the viewing angle.

In another example, U.S. Pat. No. 5,513,084 to Simpson discloses a holiday lighting decoration and method for using the same. More specifically, the Simpson device includes a motor driven carousel that displays a series of images on a transparent material. A hollow transparent support provides an upright receptacle for retention of photographs within the carousel for rotation therewith for sequentially displaying images on the transparent material by way of being illuminated by a centrally located light bulb. One problem with Simpson is that the carousel design is overly complex, namely it requires an electric motor, three separate gear assemblies (e.g., a worm drive, idler gear, and 360 degree rotational gear), related axles, linkages, fasteners, rotational friction bearings, etc. In all, the Simpson device requires a dozen or more precision interlocking mechanical parts when fully assembled. The reinforced housing carrying the mechanical elements also carries the centrally disposed lamp post relative thereto about a bearing in the form of a plastic washer. This allows the gear assembly to turn the transparent support carrying the images, relative to the upstanding light without actually turning the light. This is necessary to avoid twisting the line that provides power to the light. As such, the transparent support must rotate about the washer relative to the insert supporting the light otherwise the Simpson device will not work. As a result, the Simpson device must be hung from a hook that similarly permits rotation relative thereto, otherwise the hook itself would bind during rotation of the lighting decoration. This undesirably precludes hanging the Simpson device from a lighting structure having power lines extending therefrom.

In another reference, U.S. patent No. to Bowles discloses a lamp-box having a shell that encloses a plurality of lamps for illuminating flat negatives for retouching thereof. The front of the shell resides in a single plane and provides an opening for slide-in reception of a negative. A set of guide-ways permit insertion/removal of the negative into and out from the lamp box. In this respect, FIGS. 1-4 illustrate that the front of the lamp-box is planar or flat and would otherwise prohibit insertion of a curved backlit film image. This is important because the very purpose of the Bowles invention is to provide a simple and inexpensive box adapted for photographic work. In this respect, the negative, picture or other object may be modified while being illuminated by a light source inside. Accordingly, a negative is placed in the slide plate and in a flat position favorable for retouching. Such a planar structure prohibits three-dimensional viewing of the image around the entire exterior of the lamp box. Rather, one must sit directly in front of, and preferably perpendicular to, the plane of the negative.

In another example, U.S. Pat. No. 1,663,386 to Rice discloses illumination of a sign for "The DOE Co." that adheres directed to a substrate or sheet to form a single sheet of flexible material of uniform thickness. The two sheets are, therefore, inseparable. Such permanent affixation is particularly undesirable because the sign cannot be removed and replaced by other signage without completely replacing the entire unit (i.e., both the sign and the supporting substrate or sheet mentioned above). More specifically, Rice discloses a transparent sign constructed from two pieces of flexible transparent sheets, one sheet that includes a painted surface (e.g., with "The DOE Co." thereon) and a second support sheet. The adjacent sheets are then treated with a chemical that causes the adjacent surfaces of the sheets to adhere to one another and knit together to form a single sheet of flexible material. Chemically bonding the sheets together to form a single sheet of material is undesired because it is not possible to remove and replace for purposes of interchanging the image. The stated purpose of such chemical adhesion as disclosed by Rice is to protect the painted sheet from the weather. For example, water cannot contact the painted surface because it is inseparably bonded into a single, individual piece of material. If the two surfaces were separable, weather and moisture would be allowed to contact the printed advertising material and could cause premature wear.

The present disclosure pertains to a relatively simple and easily constructed ornament having a three-dimensional shape, particularly such as a generally cylindrical shape, wherein backlit film bearing a custom image and formed into the desired size and shape is formed into a hollow cylinder and retained by upper and lower retainer caps, for selected assembly individually or in groups with an elongated light strand having multiple light sources. Each ornament is arranged with one of the light sources positioned therein to backlight the custom film image.

SUMMARY OF THE INVENTION

The ornament with a backlit film image disclosed herein includes a substrate having an at least partially transparent portion viewable therethrough when backlit. A first end cap and a second end cap are configured to receive and retain a portion of the substrate in a substantially closed loop shape such that the first and second end caps and the substrate form an ornament that maintains a substantially upright position defining an enclosure. In this respect, an adhesive may be disposed on a portion of the substrate for retaining overlapping portions of the substrate in the closed loop shape. A light source is disposed within the enclosure and positioned to illuminate the backlit film image at least partially viewable through the transparent portion of the substrate.

In a particularly preferred embodiment, the substrate includes a substantially rigid transparent substrate. Here, the backlit film image may be attached around the outside or tensioned to expand into an inner surface of the transparent substrate for viewing. A plug may be selectively attachable to the first end cap and include an insert for selectively retaining and hanging the light source within the enclosure. In this respect, it may be preferable to include a reflector coupled to the second end cap. A domed reflector is particularly preferred as it can be positioned to reflect light from the light source onto the backlit film image. Doing so provides additional illumination against the image itself instead of allowing the light to potentially escape or dissipate through the ends of the enclosure. The domed reflector may further include a vent to permit convection cooling throughout the enclosure. The vent is particularly useful when used in conjunction with an accompanying vent formed from a portion of the first end cap.

The first and second end caps preferably include a channel configured for slide-fit reception of the substrate. The channels may include a projection configured to selectively engage respective apertures formed in a portion of the substrate. The projections may lock into the apertures by snap-tight or press-fit engagement. The first end cap may further include an insert configured to receive and hang the light source within the enclosure. Such an insert may include an x-slit or a set of flaps formed from a portion of the first end cap. Like the first end cap, the plug may also include one or more vents.

In an alternative embodiment, the substrate may include a translucent pocket defined by a pair of generally overlying films for slidably receiving and supporting the backlit film image. In another alternative embodiment, the backlit film image may be formed from a portion of the substrate. Furthermore, the light source may be coupled to an elongated strand having additional lights coupled thereto, such as a set of Christmas tree lights.

In another embodiment disclosed herein, the ornament with a backlit film image may include a curved substrate having a smooth surface and an at least partially transparent portion viewable therethrough when backlit. The backlit film image may include a flat top surface and a flat bottom surface, wherein one of the flat top surface or the flat bottom surface is positioned flush against the smooth surface of the curved substrate when the backlit film image is removably coupled thereto. A first end cap and a second end cap may be configured to selectively receive and retain at least a portion of the curved substrate. In one embodiment, the first and second end caps and the curved substrate may be supported into a substantially upright position to define an enclosure. Moreover, an insert may removably engage with the first end cap and include an aperture having a size and shape for compression-fit engagement with a light source. When engaged, the light source may be disposed within the enclosure and positioned to illuminate the backlit film image at least partially viewable through the transparent portion of the curved substrate.

In one aspect of this embodiment, the smooth surface includes an inner surface of the curved substrate and the backlit film image is tensioned to expand the flat top surface into engagement with the inner surface. In another aspect of this embodiment, the smooth surface includes an outer surface of the curved substrate and the flat bottom surface of the backlit film image wraps around at least a portion of the outer surface and may be taped or otherwise adhesively attached thereto. The first and second end caps preferably each include a channel configured for slide-fit reception of the curved substrate, wherein each channel may include a projection configured for selective engagement with a respective aperture in the curved substrate for locking engagement therewith. Furthermore, the second end cap may include a vent to permit convection cooling throughout the enclosure and a domed reflector may couple to the second end cap and be positioned to reflect light from the light source onto the backlit film image. Other features of this embodiment may include an ornament with a backlit film image wherein the curved substrate includes a cylindrical substrate, the insert is a compressible rubber insert, and the light source may be coupled to an elongated strand including a plurality of light sources coupled thereto.

In another embodiment, the ornament with a backlit film image as disclosed herein may include a substantially rigid and transparent substrate having a smooth inner surface and an at least partially transparent portion viewable therethrough when backlit. The transparent substrate may further include a translucent pocket defined by a pair of generally overlying films for slidably receiving and supporting the backlit film image. A curved backlit film image having a flat surface may be positioned adjacent the smooth inner surface of the transparent substrate when the curved backlit film image is removably coupled thereto. Here, the curved backlit film image may be tensioned so substantially the entire surface area of the flat surface expands into engagement with the smooth inner surface of the transparent substrate.

In this embodiment, a first end cap and a second end cap may be configured to selectively receive and retain a portion of the transparent substrate in a substantially closed loop shape, wherein the first and second end caps and the transparent substrate are supported into a substantially upright position to define an enclosure. One of the first or the second end caps may include a vent to permit convection cooling throughout the enclosure. Additionally, the first and second end caps may each include a channel configured for slide-fit reception of the transparent substrate, wherein each channel includes a projection configured for selective engagement with a respective aperture in the transparent substrate for locking engagement therewith. In another aspect of this embodiment, an insert may be removably engaged with one of the first or second end caps and may include an aperture having a size and shape for compression-fit engagement with a light source. When engaged, the light source may be disposed within the enclosure and positioned to illuminate the backlit film image at least partially viewable through the transparent portion of the substrate. To this end, a plurality of ornaments may each removably couple with a light source coupled to an elongated strand of light sources.

In another embodiment disclosed herein, the ornament with a backlit film image includes a substantially cylindrical substrate having a first smooth surface and a second smooth surface with at least a portion thereof being transparent and viewable therethrough when backlit. The curved backlit film image may include a printable flat top surface and a flat bottom surface tensioned to expand into the first smooth surface of the cylindrical substrate so substantially the entire surface area of the printable flat top surface seats flush against the first smooth surface of the cylindrical substrate. A first end cap and a second end cap each have a respective channel configured for slide-fit reception of the cylindrical substrate in a substantially closed loop shape, wherein the first and second end caps and the transparent substrate are supported into a substantially upright position to define an enclosure. Furthermore, a plurality of projections may be positioned within each respective channel and configured for selective engagement with a respective aperture in the cylindrical substrate for press-fit engagement therewith and a plug may be selectively attachable to the first end cap in non-rotatable relation relative thereto and may include an aperture configured for press-fit engagement with a light source for selectively retaining and hanging the light source within the enclosure, wherein the plug includes a rubber plug having an engagement channel configured for slide-in engagement with the first end cap.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
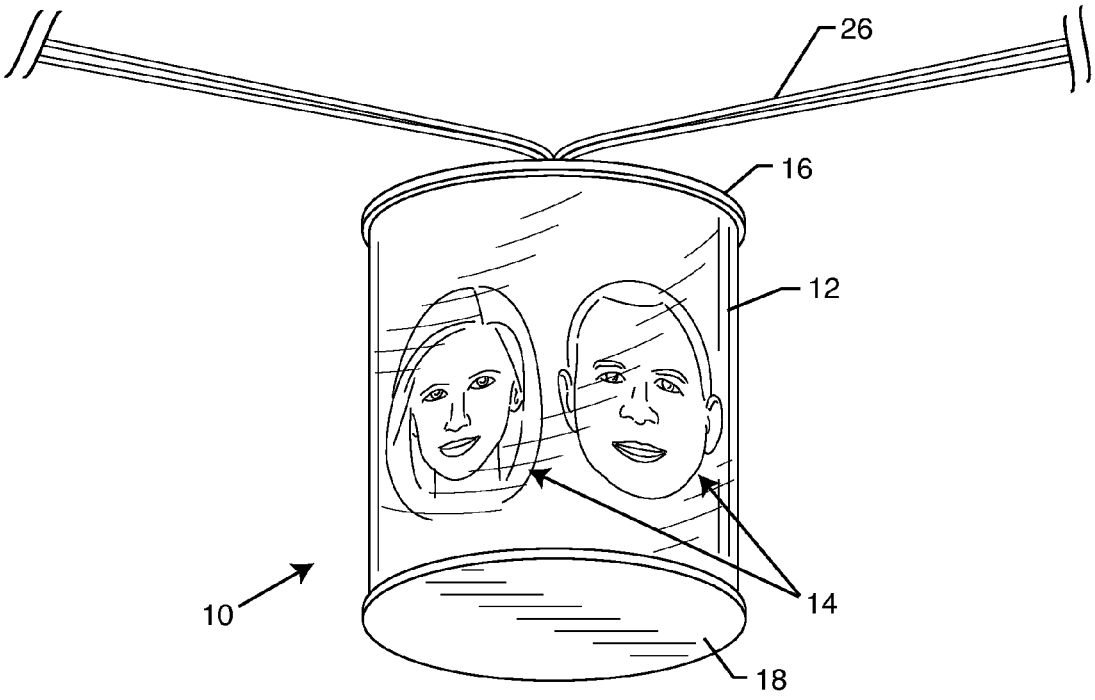
FIG. 1 is a fragmented perspective view of a backlit ornament constructed in accordance with the present disclosure.

The present invention relates to an ornament referred to generally in FIG. 1 by the reference numeral 10. The ornament comprises a sheet of backlit film 12 bearing a custom-printed image 14 and rolled into a generally cylindrical shape retained by a pair of generally circular upper and lower retainer caps 16 and 18. At least the upper retainer cap 16 has an opening 20 (FIG. 2) formed therein for slide-fit reception of and engagement with the base 22 or the like of a light source 24 (FIG. 3), such as a small light mounted along the length of an elongated strand 26 of conductors carrying multiple light sources of a type used in a conventional strand of decorative Christmas or holiday lights or the like.

The sheet of backlit film 12 comprises a sheet of known backlit film material such as that commercially available in rolls of different sheet lengths suitable for use with wide format inkjet media from Eastman Kodak Company, Rochester, N.Y., under the brand name Kodak Premium Backlit Film, or from Hewlett-Packard Development Company of Houston, Tex., under the brand name HP Premium Vivid Color Backlit Film. Such backlit film is quickly and easily used to apply by printing the custom image 14 thereto, such as a photograph or portion thereof displaying the image of friends or family members, as shown in the illustrative drawings. Persons skilled in the art will recognize and appreciate, however, that alternative backlit film sheets in planar form, such as in 8.5×11 inch sheets, can be used in a standard home inkjet printer or the like.

Backlit film is particularly preferred as it produces a different visual effect when compared to transparent film.

More specifically, transparent film permits viewing through the film in areas where a color or visual image is not present, and may even permit viewing through the film in areas where a lighter color or image is present. This occurs because there is no background. As a result, the transparent film permits viewing into the body of the ornament, such as the light source disclosed in the Simpson reference described above. This is not the case with opaque backlit film. Rather, backlit film is akin to printing an image to white paper, which was only recently made possible, in part, through advancements in digital printing and media technologies. In one embodiment, the backlit film may be made from a matte on the printing side and a gloss on the other side. In general, the backlit film is typically from 40% to 90% opaque, although, preferably, the backlit film is 77% opaque. Higher opacity tends to hold vivid photographic colors better in reflective light. Transparent film, as mentioned above, does not. Accordingly, the opacity of the backlit film enhances maximum color transmittal, even without light. Transparent film, on the other hand, requires illumination, otherwise the color scheme looks dark and muted because there is no background to fall back on. Transparent film may work well for overhead projectors where the image is viewed on a screen as opposed to viewed directly, whereas backlit film is best viewed directly because of its opacity.

After printing of the custom image 14 onto the backlit film sheet 12, the backlit film sheet 12 is cut into a desired length and width for subsequent rolling into a generally hollow cylindrical shape. In this regard, in accordance with one preferred form of the invention, the backlit film sheet 12 is trimmed to include the custom image 14, with an exemplary sheet length of at least about 5.5 inches and a selected height on the order of about 2-3 inches (as viewed in FIG. 2). When this trimmed backlit sheet 12 bearing the custom image 14 is rolled into a hollow cylindrical shape having a diametric size of about 1.75 inches, there is a slight overlap of the opposed ends of the sheet 12. A thin layer of a selected adhesive 28 (FIG. 2) can be applied to one of these overlapping ends for securing the backlit film sheet 12 in the cylindrical shape of the desired size. Persons skilled in the art will recognize, however, that alternative means may be used for securing the opposite ends of the backlit film sheet 12, and/or that the film sheet 12 can be rolled into a different cylindrical size. Persons skilled in the art will also recognize that the entire backlit film sheet 12 may be coated on the reverse or rear side with a suitable pressure sensitive adhesive, in lieu of the selected adhesive 28.

The cylindrical backlit film sheet 12, bearing the custom image 14, is then assembled quickly and easily with the pair of upper and lower retainer caps 16 and 18, respectively. The upper and lower retainer caps 16, 18 are preferably lightweight, thin (e.g., 0.045 mm), flexible and made from a thermoplastic material. As shown best in FIG. 2, both of these retainers caps 16, 18 include an annular rim 30 against which the associated upper or lower end of the cylindrical film sheet 12 fits snugly, in combination with an outwardly radiating upper or lower flange 32 that projects a short distance beyond the film sheet 12 assembled against the rim 30. Both caps 16, 18 are desirably constructed from a lightweight and economical plastic material. If desired, a small adhesive bead (not shown) can be applied to the rims 30, or alternately to the reverse side of the film sheet 12 along the top and bottom edges, for more permanently securing the film sheet 12 to the cap rims 30. As a further alternative, persons skilled in the art will appreciate that a shallow groove (not shown) may be included at the juncture of the rim 30 and flange 32 for assisting in support and retention of the backlit film sheet 12.

Figure 2:
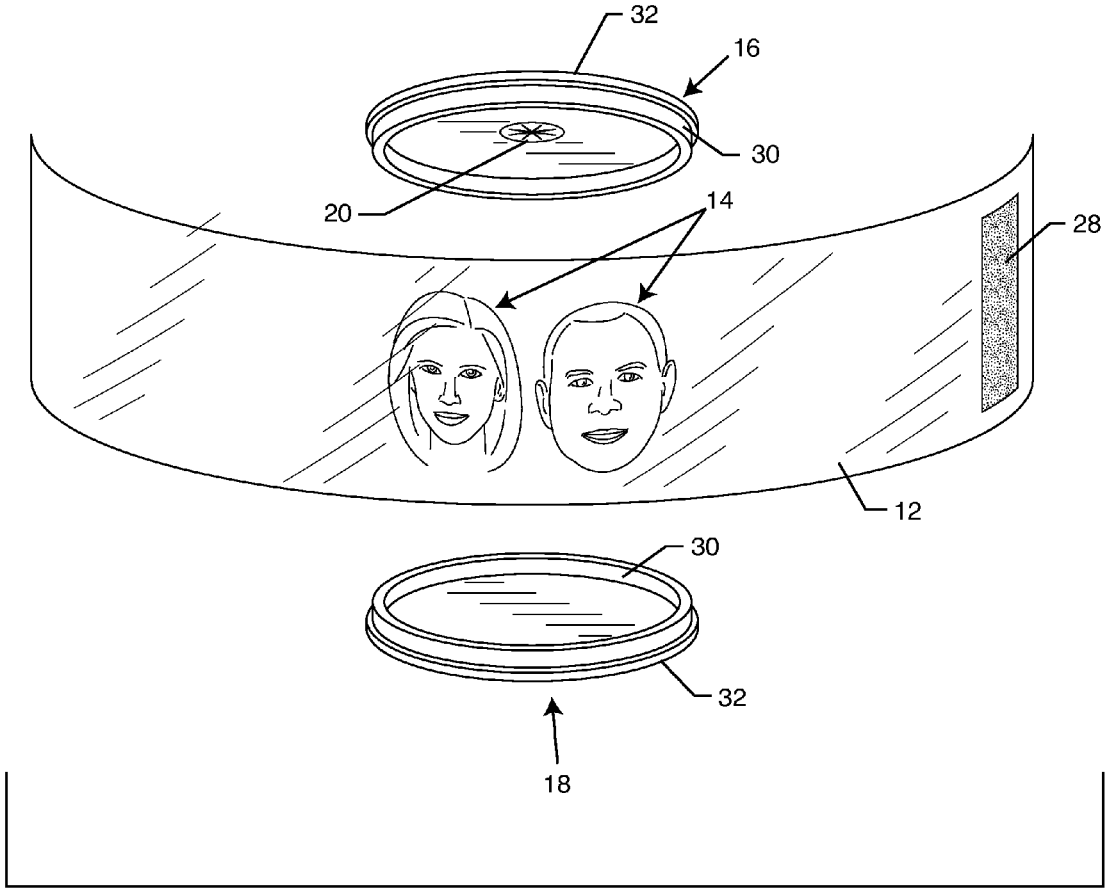
FIG. 2 is a perspective view showing a backlit film sheet bearing an image in exploded relation with upper and lower caps.
Figure 3:
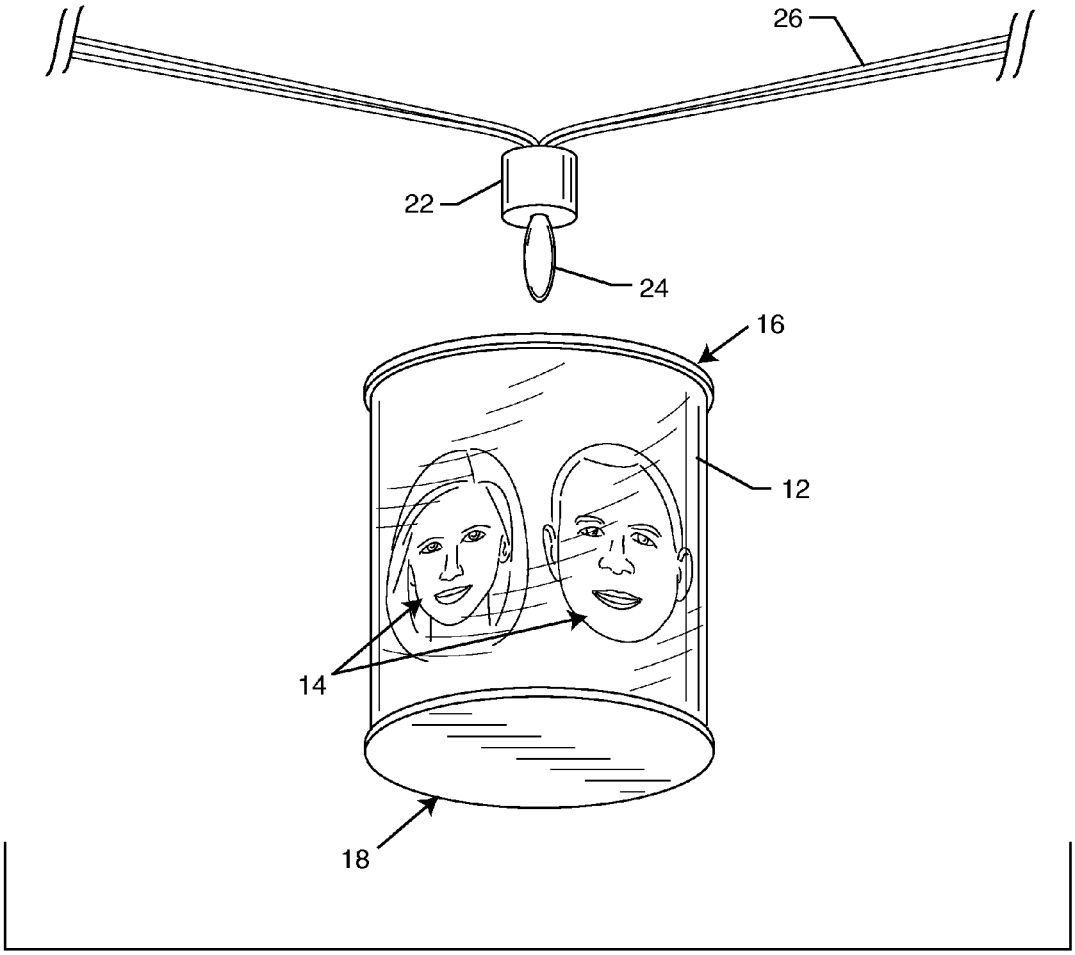
FIG. 3 is a perspective view showing the assembled ornament in exploded relation with an illuminating light source, such as a Christmas tree light strand.

At least one of the upper and lower retainer caps 16, 18, and preferably the upper cap 16, includes the small opening 20 for receiving and supporting the base 22 of one of light source 24. FIG. 2 shows the upper cap 16 having an X-slit formed centrally therein as the opening 20. Prior to receiving the light source 24, the X-slit 20 is substantially closed to prevent light leakage from the hollow ornament interior. But the X-slit 20 accommodates quick and easy press-fit reception of the light source 24 for friction-fit engagement of the light base 22 in a manner which securely supports and positions the associated light source 24 within the hollow ornament interior (FIGS. 1-3).

The light source 24 thus back-illuminates the custom image 14 on the now-cylindrical back-lit film sheet 12, resulting in a highly pleasing and different type of ornament visually displaying the custom image 14, such as the exemplary photograph of friends and/or family members, or other selected customized artwork. This ornament 10 can be used alone, preferably mounted at a selected location along a strand 26 of lights 24 in association with one of the lights 24 (FIGS. 1-3), or alternately, multiple ornaments 10 each having the same or a different custom image 14 printed thereon can be mounted along the strand 26 (FIG. 4) each in association with a respective one of the lights 24. In either case, the resultant ornament or ornaments 10 provide a unique and pleasing custom decorative effect that is especially suited for use as a holiday decoration such as Christmas and the like.

Figure 5:
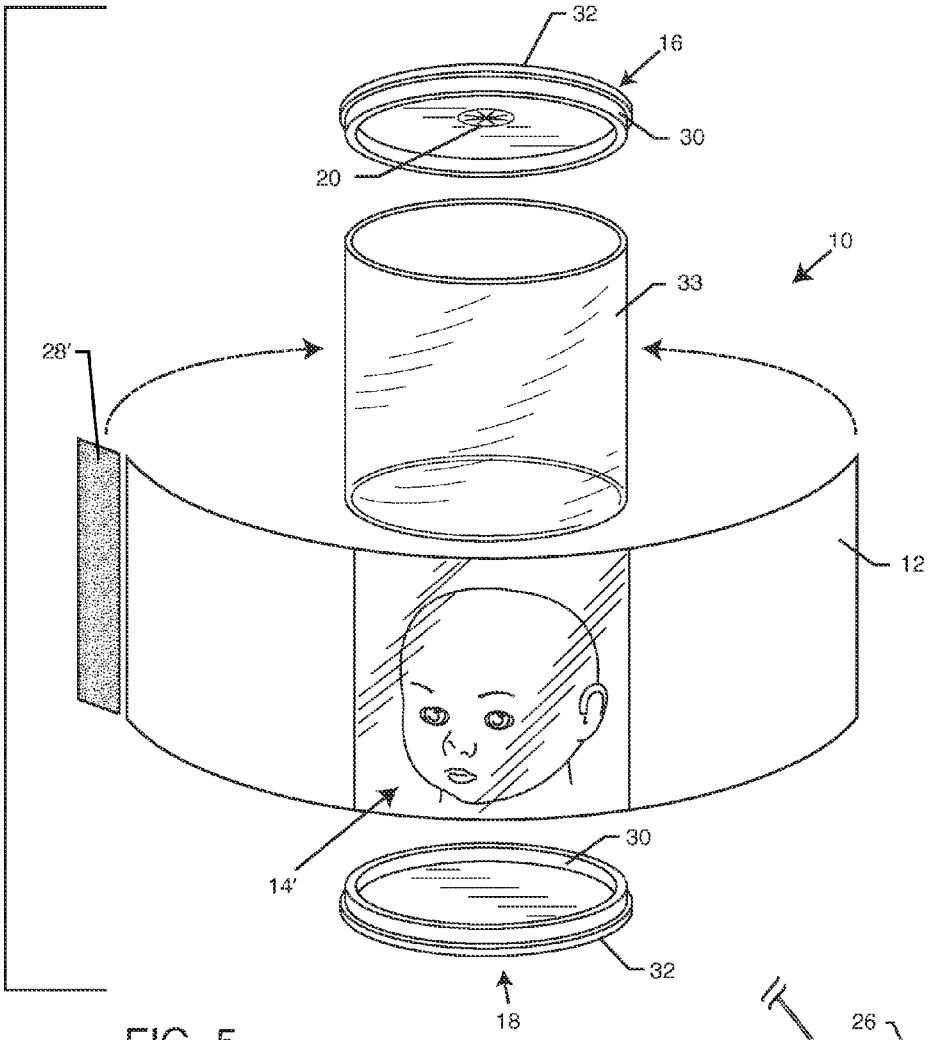
FIG. 5 is an exploded perspective view of an alternative ornament, including a transparent sleeve for supporting the backlit film.
Figure 6:
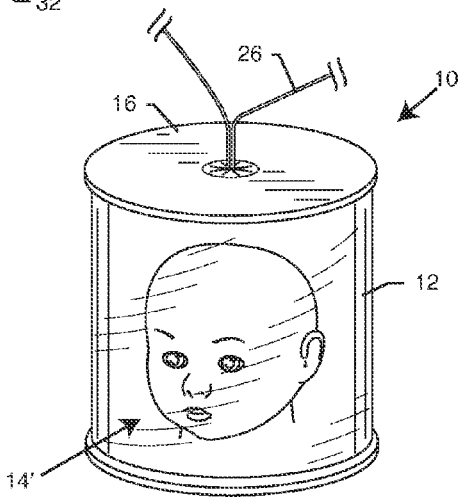
FIG. 6 is an assembled perspective view of the ornament of FIG. 5.

Additionally, FIGS. 5-6 illustrate another embodiment of the ornament 10, including a transparent sleeve 33 for use in supporting the backlit film 12 when connected to the upper retainer cap 16 and the lower retainer cap 18. The transparent sleeve 33 is generally formed from a somewhat rigid or hard plastic support layer configured to receive the backlit film 12 in a supportive upright position. As shown best in FIGS. 5,8 and 9-12, the transparent sleeve 33 (and the sleeve 33', as described below) includes a smooth inner cylindrical surface and a smooth outer cylindrical surface. As described above, the backlit film 12, such as the one shown in FIG. 5, is preferably cut to a height that is approximately the same height as the transparent sleeve 33. Furthermore, the backlit film 12 is preferably cut to a length that allows the film 12 to easily encompass the outer diameter of the transparent sleeve 33 in a manner that allows partial overlap so that the adhesive 28', such as clear plastic tape, a gel-like adhesive, or the like, can adhere adjoining sections of the backlit film 12 generally circumferentially around the exterior of the transparent sleeve 33. As such, the backlit film 12 containing an alternative image 14' easily wraps around and attaches to the outside of the transparent sleeve 33 such that substantially the entire area of its flat bottom surface is positioned flush against the smooth outer cylindrical surface of the transparent sleeve 33. The backlit image 12 may also be cut somewhat short such that portions of the film 12 do not overlap when placed around the exterior of the transparent sleeve 33. Here, it may be necessary to apply two strips of the adhesive 28' to hold each end of the backlit film 12 around the exterior of the transparent sleeve 33. In this embodiment, the backlit film 12 may be adhered to a portion of the transparent sleeve 33 instead of to itself. The backlit film 12 with the accompany image 14' may be attached to the transparent sleeve 33 before or after connection to the upper and lower end caps 16, 18, as described below.

The transparent sleeve 33 is connected to the upper and lower end caps 16, 18 in accordance with the embodiments disclosed herein. For example, with respect to FIGS. 5 and 6, the upper and lower retainer caps 16, 18 may attach by slide-fit or snap-fit engagement of the respective annular rims 30 within the interior of the transparent sleeve 33. In this embodiment, the annular rims 30 are retained within the interior of the transparent sleeve 33 by friction fit. As such, the retainer caps 16, 18 are selectively removable from the transparent sleeve 33 by unfitting or unsnapping the annular rims 30 out from within the transparent sleeve 33. Alternative embodiments may include other means for mechanically or adhesively attaching (permanently or temporarily) the retainer caps 16, 18 to the transparent sleeve 33. Once fully assembled as shown in FIG. 6, the aforementioned light source connected to the elongated strand 26 may be disposed within the interior of the transparent sleeve 33 to illuminate the image 14' on the backlit film 12.

Figure 7:
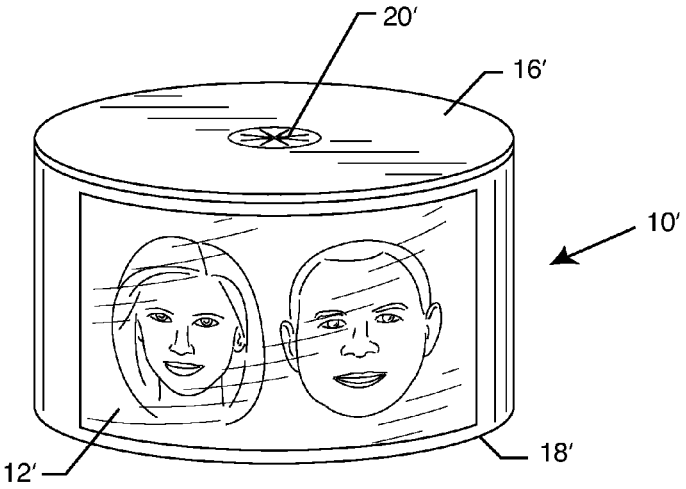
FIG. 7 is a perspective view showing one alternative preferred form of the ornament disclosed herein.
Figure 8:
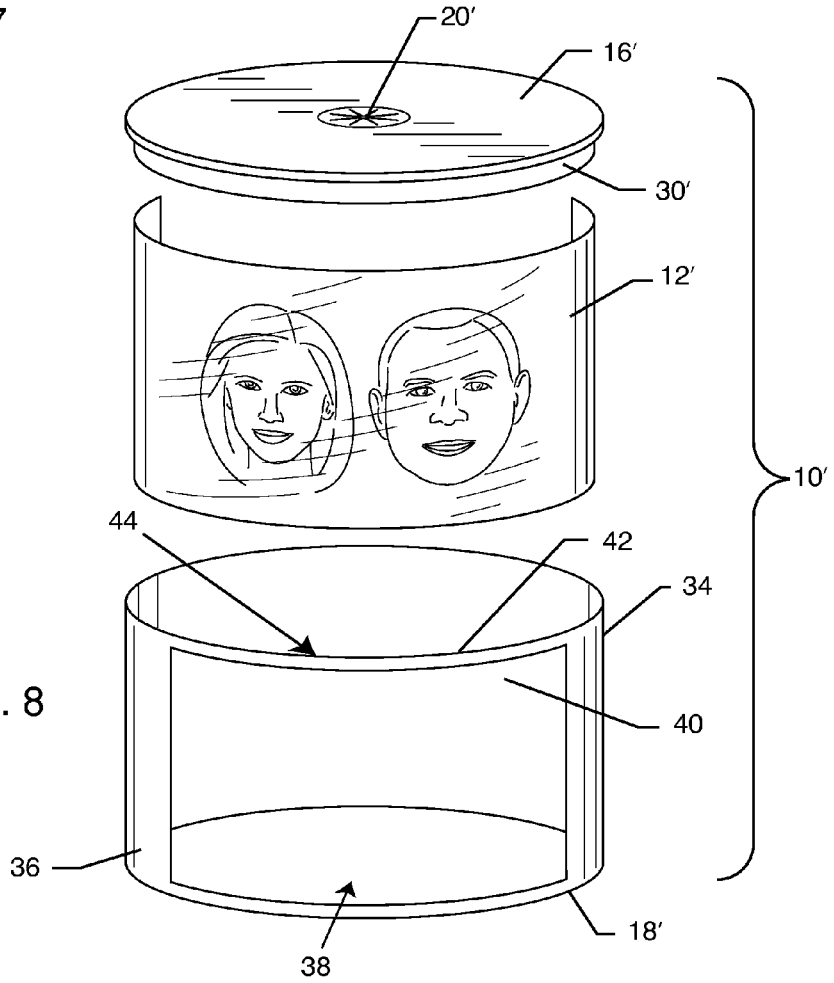
FIG. 8 is an exploded perspective view showing the alternative embodiment of FIG. 7.

An alternative preferred embodiment of the invention is shown in FIGS. 7-8. As shown, a modified ornament 10' is provided in a generally non-cylindrical shape such as the illustrative oval or elliptical configuration, with an upstanding closed loop wall segment 34 having a opaque or translucent region 36 lining a frontal portion or segment 38 defined by a pair of generally transparent overlying films 40, 42 forming an upwardly open pocket 44 for slidably receiving and supporting a piece of backlit film 12' having a selected image printed thereon. The surfaces forming the pocket 44 are generally smooth to mitigate refraction of light therein. After printing the selected image, the backlit film 12' is trimmed to size as needed, and then slidably fitted into the upwardly open pocket 44 between the transparent films 40, 42, and an upper lid or cap 16' is fitted onto the underlying closed loop wall segment 12' as by slidably fitting an annular rim 30' into said wall segment 12'. If desired, an adhesive bead (not shown) can be used to essentially permanently secure these components together. A lower lid or cap 18' may also be fitted onto the lower end of the closed loop wall segment 12', as needed or desired.

Figure 4:
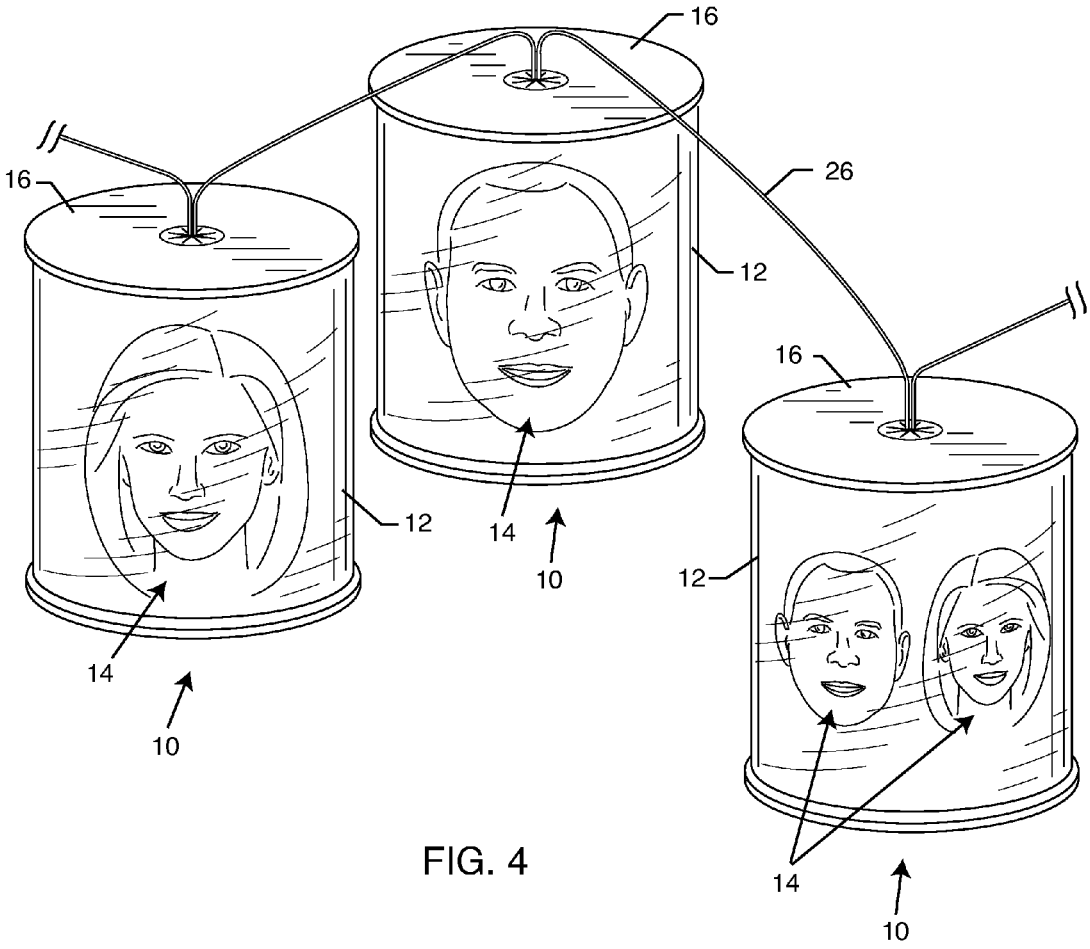
FIG. 4 is a perspective view showing multiple ornaments, each coupled to a light source on an elongated strand.

The upper lid or cap 16' includes a central opening 20', such as an X-slit as previously shown and described with respect to FIGS. 1-4, for receiving and retaining the light 24 (not shown in FIGS. 7-8) such as one of multiple holiday lights 24 on the strand 26 as viewed in FIG. 4. In use, the resultant ornament 10' receives and supports the backlit film 12' with the selected image thereon for suitable backlighting by means of the light 24, with the balance of the ornament 10' being constructed to be substantially opaque or translucent to provide a pleasing lighted ornament.

Figure 9:
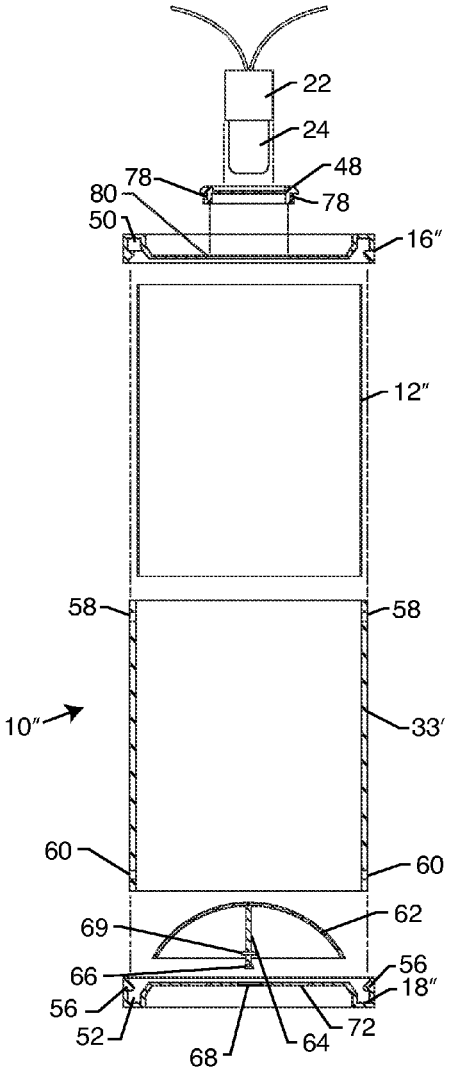
FIG. 9 is an exploded cross-sectional view of an alternative ornament with a backlit image, including a substantially rigid transparent sleeve that snaps into a pair of end caps.

Furthermore, FIGS. 9-13 illustrate an alternative embodiment of the ornament with a backlit film image as disclosed herein. More specifically, FIG. 9 illustrates an exploded cross-sectional view of an alternative ornament 10" including a modified upper retainer cap 16", a modified lower retainer cap 18", a modified transparent sleeve 33', a backlit film 12" and a plug 48 that slidably engages the upper retainer cap 16". In this embodiment, each of the upper and lower retainer caps 16", 18" include an upper and lower channel 50, 52, respectively configured for slide-fit reception of the transparent sleeve 33'. Additionally, the upper and lower retainer caps 16", 18" both include a series of upper and lower engagement projections 54, 56 configured to slidably engage one of a plurality of the upper or lower apertures 58, 60 formed out of the transparent sleeve 33'. Engagement of the upper and lower apertures 58, 60 with the upper and lower engagement projections 54, 56 is described in more detail below with respect to FIG. 11.

Figure 10:
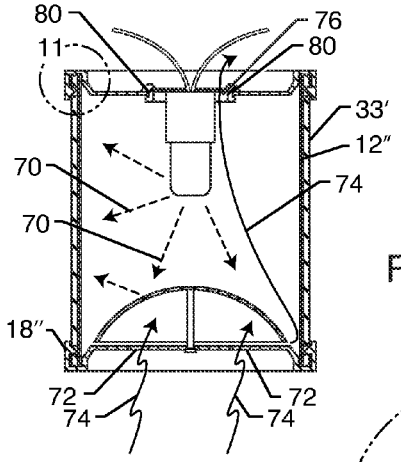
FIG. 10 is an assembled cross-sectional view of the alternative ornament of FIG. 9.

Furthermore, the ornament 10" shown in FIG. 9 includes a domed reflector 62 having an extension 64 with a flared end 66 configured to snap-fit or press-fit engage a retaining aperture 68 in the lower retainer cap 18". The diameter of the retaining aperture 68 is preferably approximately the same diameter as the outer diameter of the extension 64. In this respect, it may be preferable that the diameter of the retaining aperture 68 be somewhat slightly larger than the outer diameter of the extension 64 to facilitate slide-fit reception thereof. The flared end 66 is also preferably sized to slidably extend through the retaining aperture 68 yet wide enough to retain the domed reflector 62, as generally shown in FIG. 10, to the lower retainer cap 18". Once inserted, the domed reflector 62 remains affixed as the flared end 68 and a stop collar 69 sandwiches a portion of the lower retainer cap 18" therebetween. Here, the domed reflector 62 is removably affixed to the lower retainer cap 18". Removal simply requires pulling the extension 64 and the flared end 66 back through the retaining aperture 68. Alternatively, the domed reflector 62 may be temporarily or permanently adhesively or mechanically attached (e.g., screwed or nailed) to the lower retainer cap 18".

Use of the domed reflector 62 reduces light fall-off through the bottom of the ornament 10" and serves as a baffle for ventilation holes. Additionally, it may also be desirable to couple a domed reflector to the upper retainer cap 18" (not shown). Of course, such an upper domed reflector would need to facilitate extension of the light source 24 therethrough. FIG. 10 more specifically illustrates a series of light waves 70 reflecting off the domed reflector 62 for redirection into the transparent sleeve 33' and the backlit film 12". Preferably, the interior surface of the domed reflector 62 is made from or coated with a reflective material. Additionally, FIG. 10 further illustrates a plurality of ventilation apertures 72 in the lower retainer cap 18" allowing a series of heat waves 74 to enter into the enclosure of the ornament 10", proceed around the domed reflector 62, and exit out through a set of plug or upper retainer cap ventilation apertures 76. The ventilation apertures 72, 76 facilitate airflow through the interior of the ornament 10" so that the ornament 10" is capable of convective cooling throughout the interior enclosure.

Figure 11:
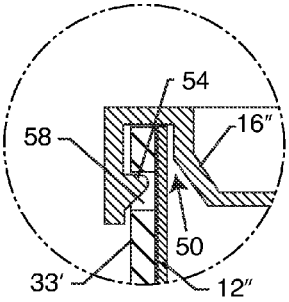
FIG. 11 is an enlarged cross-sectional view taken about the circle 11 in FIG. 10, further illustrating snap-fit reception of the end cap into the transparent sleeve.
Figure 12:
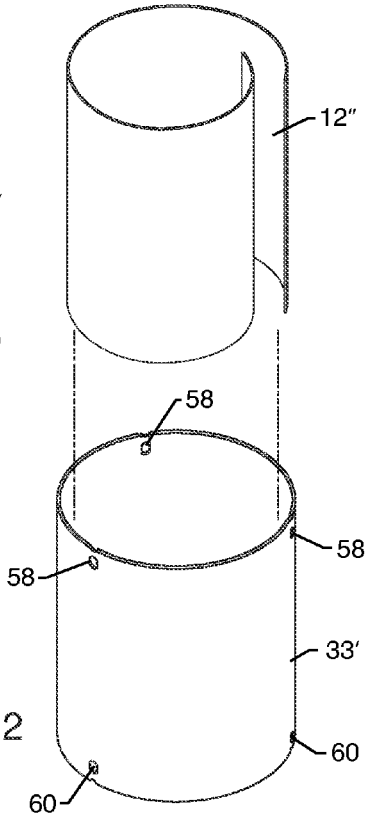
FIG. 12 is an partial exploded perspective view illustrating slide fit reception of the backlit film within the transparent sleeve.

FIG. 11 is an enlarged cross-sectional view illustrating engagement of the upper retainer cap 16" with the transparent sleeve 33'. More specifically, FIG. 11 illustrates engagement of the upper engagement projection 54 with the upper aperture 58 such that the upper retainer cap 16" removably engages the transparent sleeve 33'. The upper channel 50 may flex outwardly to accommodate insertion of the transparent sleeve 33' around the upper engagement projection 54. For example, the upper retainer cap 16" may be made from a substantially resilient and lightweight plastic material that permits slight outward flexing about the upper channel 50. This allows for enlargement of the upper channel 50 to facilitate insertion of the transparent sleeve 33' therein, such that the upper engagement projection 54 may slidably insert into and engage the upper aperture 58. Once engaged, the resilient plastic material comprising the upper retainer cap 16" retains its shape substantially as shown in FIG. 11. FIG. 11 further illustrates the flat bottom surface of the backlit film 12" positioned flush against the smooth outer surface of the transparent sleeve 33'. As shown in FIG. 12, the transparent sleeve 33' includes a plurality of upper apertures 58 circumferentially disposed about an upper portion thereof and configured for slide-fit or snap-fit engagement with a plurality of the upper engagement projections 54 disposed circumferentially around the interior of the upper channel 50 of the upper retainer cap 16". Accordingly, each upper engagement projection 54 engages a respective upper aperture 58 to ensure the upper retainer cap 16" remains substantially affixed to the transparent sleeve 33'. Further to FIG. 12, the backlit image 12" may be flexible such that it can be manipulated into the curved configuration as shown, wherein substantially the entire area of the flat top surface of the backlit film 12" can be positioned flush against the smooth inner surface of the transparent sleeve 33' at least in part because the transparent sleeve 33' does not include any corrugations. This enhances visibility of the image 14 on the backlit film 12" when the light source 24 is illuminated.

Likewise, the transparent sleeve 33' includes the plurality of lower apertures 60 (FIG. 12) configured for slide-fit engagement with the plurality of corresponding lower engagement projections 56 in the lower retainer cap 18". The lower retainer cap 18" is also preferably manufactured from a substantially resilient yet flexible plastic material that allows for enlargement of the lower channel 52 upon desired insertion of the transparent sleeve 33' therein. In this respect, the lower channel 52 may flex outwardly to accommodate insertion of the transparent sleeve 33' beyond the lower engagement projections 56 for slide-fit or press-fit engagement with the corresponding lower apertures 60. Once engaged, the substantially resilient plastic material recovers back to its preferred shape as shown in FIGS. 9-10. Removal of either of the upper or lower engagement projections 54, 56 from the respective upper or lower apertures 58, 60 requires flexing the upper or lower retainer cap 16", 18" outwardly, thereby expanding the respective upper and/or lower channels 50, 52, to facilitate disengagement the projections 54, 56 from the apertures 58, 60.

In an alternative embodiment, the transparent sleeve 33' and/or the backlit film 12" may be permanently affixed to each of the upper retainer cap 16" and/or the lower retainer cap 18" by disposing an adhesive (not shown) in each of the respective upper and/or lower channels 50, 52. The adhesive bonds respective portions of the transparent sleeve 33' to the upper and lower retainer caps 16", 18". This embodiment may be more robust than other embodiments disclosed herein as it is not meant to be disassembled. Additionally, in another alternative embodiment, one or both of the retainer caps 16, 18 may screw into and out from a portion of the transparent sleeve 33' to be secured thereto or removed therefrom.

FIG. 12 is a partial exploded perspective view illustrating that the backlit film 12" slidably resides within the interior of the transparent out sleeve 33'. The backlit film 12", when assembled, is located to the interior of the transparent sleeve 33' in a manner best shown in FIG. 11. The backlit film 12" is configured to outwardly expand flush against the interior surface of the transparent sleeve 33', as described above. In this respect, the transparent sleeve 33' acts as a support that positions or carries the backlit film 12". The engagement projections 54, 56 are configured to wholly or partially extend into the apertures 58, 60 in the transparent sleeve 33', as best shown in FIG. 11, only so much as to allow for flush mounting of the backlit film 12" against the interior of the transparent sleeve 33'. Like the transparent sleeve 33', portions of the backlit film 12" may reside within respective upper and lower channels 50, 52 in the upper and lower retainer caps 16", 18". In a particularly preferred embodiment, the backlit film 12" may be sandwiched between a portion of the channel 50 and/or 52 and the interior of the transparent sleeve 33' upon press-fit engagement of the upper and lower engagement projections 54, 56 with the upper and lower apertures 58, 60 to prevent future movement of the backlit film 12" should the ornament 10" move after assembly. Of course, as described above, each of the upper and lower channels 50, 52 may include or be configured to receive an adhesive that glues the backlit film 12" and/or the transparent sleeve 33' to the upper and/or lower retainer caps 16", 18".

Figure 13:
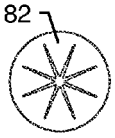
FIG. 13 is a top view of a plug selectively insertable into the top end cap.

Another feature of the ornament 10" shown with respect to FIGS. 9-10 and 11 is the plug 48, which is preferably made from a rubber material. The plug 48 preferably inserts into the upper retainer cap 16" for compression and/or press-fit engagement therewith. In a similar manner, the plug 48 may selectively receive the light source 24 and/or the base 22 for similar compression and/or press-fit engagement therewith to affix the light source 24 in place. In this respect, the plug 48 may further include an engagement channel 78 that selectively engages a flange 80 formed from a portion of the upper retainer cap 16". The plug 48 may selectively snap into or be removed from the upper retainer cap 16", as needed. In one embodiment, the plug 48 disclosed herein includes a plurality of flexible insertion flaps 82, as shown in FIG. 13, capable of flexing to receive the aforementioned base 22 and the light source 24 by friction-fit reception. The insertion flaps 82 may operate in a manner similar to the aforementioned small opening/X-slit 20 described with respect to the embodiments above. Of course, a person of ordinary skill in the art will readily recognize that there may be many different ways of facilitating insertion, retention and/or connection of the light source 24 (and possible the corresponding base 22) into the interior of the transparent sleeve 33' to accomplish backlit lighting of the film 12". The removable aspect of the plug 48 allows the ornament 10" to be used with different lighting fixtures. For example, instead of slide-fit reception of the base 22 and the light source 24, the plug 48 may be made as part of a pre-formed combination light source and plug. Here, the plug/light source simply attach to the ornament 10" through snap-fit or press-fit engagement of the engagement channel 78 with the flange 80. This embodiment may be particularly preferred for use with the aforementioned elongated strand 26, such as for use in stringing multiple ornaments 10, 10', 10" in association with the Christmas tree strand as shown in FIG. 4.

Persons skilled in the art will recognize and appreciate that the closed loop shape of the ornament 10, 10', 10" can be provided in virtually any desired closed loop configuration, such as circular (FIGS. 1-6 and 9-13) or oval (FIGS. 7-8) as shown, or alternative closed loop shapes including but not limited to triangles, rectangles and other polygons, truncated cones, and the like. Additionally, the backlit film 12, 12', 12" is preferably flexible and at least substantially smooth on each side such that the backlit film 12, 12', 12" sits flush with the surface area of the transparent sleeve 33 substantially along its entire surface area. In this respect, the backlit film 12, 12', 12" may have a consistent thickness throughout its entire surface area, which means the backlit film 12, 12', 12" is free of projections, lumps, indentations, etc.

Although several embodiments have been described in detail for purposes of illustration, various modifications may be made to each without departing from the scope and spirit of the invention. Accordingly, the invention is not to be limited, except as by the appended claims.

What is claimed is:

1. An ornament with a backlit film image, comprising:

a curved substrate having a smooth surface and an at least partially transparent portion viewable therethrough when backlit;

a backlit film image having a flat top surface and a flat bottom surface, one of the flat top surface or the flat bottom surface being positioned flush against the smooth surface of the curved substrate when the backlit film image is removably coupled thereto;

a first end cap and a second end cap configured to selectively receive and retain at least a portion of the curved substrate, wherein the first and second end caps and the curved substrate are supported into a substantially upright position to define an enclosure; and an insert comprising a compressible rubber insert removably engaged with the first end cap and including an aperture having a size and shape for compression-fit engagement with a light source.

2. The ornament of claim 1, wherein when engaged, the light source is disposed within the enclosure and positioned to illuminate the backlit film image at least partially viewable through the transparent portion of the curved substrate.

3. The ornament of claim 1, wherein the curved substrate comprises a cylindrical substrate.

4. The ornament of claim 1, wherein the smooth surface comprises an inner surface of the curved substrate and the backlit film image is tensioned to expand the flat top surface into engagement with the inner surface.

5. The ornament of claim 1, wherein the smooth surface comprises an outer surface of the curved substrate and the flat bottom surface of the backlit film image wraps around at least a portion of the outer surface.

6. The ornament of claim 1, including a domed reflector coupled to the second end cap and positioned to reflect light from the light source onto the backlit film image.

7. The ornament of claim 1, wherein the second end cap includes a vent to permit convection cooling throughout the enclosure.

8. The ornament of claim 1, wherein the first and second end caps each include a channel configured for slide-fit reception of the curved substrate.

9. The ornament of claim 8, wherein each channel includes a projection configured for selective engagement with a respective aperture in the curved substrate for locking engagement therewith.

10. The ornament of claim 1, wherein the light source is coupled to an elongated strand including a plurality of light sources coupled thereto.

11. An ornament with a backlit film image, comprising:

a substantially rigid and transparent substrate having a smooth inner surface and an at least partially transparent portion viewable therethrough when backlit;

a curved backlit film image having a flat surface positioned adjacent the smooth inner surface of the transparent substrate when the curved backlit film image is removably coupled thereto;

a first end cap and a second end cap configured to receive and retain a portion of the transparent substrate in a substantially closed loop shape, wherein the first and second end caps and the transparent substrate are supported into a substantially upright position to define an enclosure; and an insert comprising a compressible rubber insert removably engaged with one of the first or second end caps and including an aperture having a size and shape for compression-fit engagement with a light source.

12. The ornament of claim 11, wherein the curved backlit film image is tensioned so substantially the entire surface area of the flat surface expands into engagement with the smooth inner surface of the transparent substrate.

13. The ornament of claim 11, wherein the first or the second end cap includes a vent to permit convection cooling throughout the enclosure, and the first and second end caps each include a channel configured for slide-fit reception of the transparent substrate.

14. The ornament of claim 13, wherein each channel includes a projection configured for selective engagement with a respective aperture in the transparent substrate for locking engagement therewith.

15. The ornament of claim 11, wherein when engaged, the light source is disposed within the enclosure and positioned to illuminate the backlit film image at least partially viewable through the transparent portion of the substrate.

16. The ornament of claim 11, wherein the transparent substrate includes a translucent pocket defined by a pair of generally overlying films for slidably receiving and supporting the backlit film image.

17. The ornament of claim 11, including a plurality of ornaments each removably coupled with a light source coupled to an elongated strand of light sources.

18. An ornament with a backlit film image, comprising:

a substantially cylindrical substrate having a first smooth surface and a second smooth surface with at least a portion thereof being transparent and viewable therethrough when backlit;

a curved backlit film image having a printable flat top surface and a flat bottom surface, the printable flat top surface tensioned to expand into the first smooth surface of the cylindrical substrate so substantially the entire surface area of the printable flat top surface seats flush against the first smooth surface of the cylindrical substrate;

a first end cap and a second end cap each having a respective channel configured for slide-fit reception of the cylindrical substrate, wherein the first and second end caps and the cylindrical substrate are supported into a substantially upright position to define an enclosure;

a plurality of projections positioned within each respective channel and configured for selective engagement with a respective aperture in the cylindrical substrate for press-fit engagement therewith; and a plug selectively attachable to the first end cap in non-rotatable relation relative thereto and including an aperture configured for press-fit engagement with a light source for selectively retaining and hanging the light source within the enclosure.

19. The ornament of claim 18, wherein the plug comprises a rubber plug having an engagement channel configured for slide-in engagement with the first end cap.

* * * * *